US010822064B2

(12) United States Patent
Divry

(10) Patent No.: US 10,822,064 B2
(45) Date of Patent: Nov. 3, 2020

(54) HITCHING DEVICE

(71) Applicant: WETTONCRAFT, Roncq (FR)

(72) Inventor: Eric Divry, Linselles (FR)

(73) Assignee: WETTONCRAFT, Tourcoing (FR)

( * ) Notice: Subject to any disclaimer, the term of this patent is extended or adjusted under 35 U.S.C. 154(b) by 38 days.

(21) Appl. No.: 16/308,074

(22) PCT Filed: Jun. 7, 2017

(86) PCT No.: PCT/EP2017/063877
§ 371 (c)(1),
(2) Date: Dec. 7, 2018

(87) PCT Pub. No.: WO2017/211912
PCT Pub. Date: Dec. 14, 2017

(65) Prior Publication Data

US 2019/0308706 A1 Oct. 10, 2019

(30) Foreign Application Priority Data

Jun. 7, 2016 (FR) ..... 16 55217

(51) Int. Cl.

| | |
|---|---|
| ***B63C 13/00*** | (2006.01) |
| ***B63B 59/02*** | (2006.01) |
| *B63B 17/02* | (2006.01) |
| *B63B 21/64* | (2006.01) |

(52) U.S. Cl.
CPC ..... *B63C 13/00* (2013.01); *B63B 59/02* (2013.01); *B63B 17/02* (2013.01); *B63B 21/64* (2013.01)

(58) Field of Classification Search
CPC ..... B63C 13/00; B63B 59/02; B63B 17/02
See application file for complete search history.

(56) References Cited

U.S. PATENT DOCUMENTS 3,289,225 A * 12/1966 Isch ..... B63C 13/00 114/344
3,599,256 A * 8/1971 Carroll, Jr. ..... B63C 13/00 114/344
3,608,111 A * 9/1971 Herden ..... B63C 13/00 114/344

(Continued)

FOREIGN PATENT DOCUMENTS

| | | |
|---|---|---|
| CH | 441019 A | 7/1967 |
| DE | 8509710 U1 | 8/1985 |
| FR | 2568215 A1 | 1/1986 |

OTHER PUBLICATIONS

International Search Report from corresponding International Application No. PCT/EP2017/063877, dated Sep. 7, 2017, pp. 1-3, European Patent Office, Rijswijk, The Netherlands.

*Primary Examiner* — S. Joseph Morano
*Assistant Examiner* — Jovon E Hayes
(74) *Attorney, Agent, or Firm* — Hauptman Ham, LLP

(57) ABSTRACT

The invention concerns a boat (10) comprising a hull (11) that is suitable for being towed on a solid surface and comprises a hitching device (30) comprising a straight drawbar (39) and a hitching mechanism (31), characterised in that the hitching device is movable in translation along an axis parallel to a longitudinal axis of the hull (11) between a stowed position in which the hitching device is more retracted into the hull and a deployed position in which the hitching device extends further out of the hull than when in the stowed position.

18 Claims, 3 Drawing Sheets

(56) References Cited

U.S. PATENT DOCUMENTS

| | | | | | |
|---|---|---|---|---|---|
| 4,023,222 | A * | 5/1977 | Selby | B60F 3/0092 | 114/344 |
| 4,398,489 | A * | 8/1983 | Feola | B63C 13/00 | 114/344 |
| 5,199,372 | A * | 4/1993 | Seligman | B60F 3/003 | 114/344 |
| 6,159,058 | A * | 12/2000 | Matheson | B63C 13/00 | 114/344 |
| 6,446,569 | B1 * | 9/2002 | Pitts | B60P 3/1041 | 114/344 |
| 6,662,743 | B1 * | 12/2003 | Rolfe | B63B 7/04 | 114/344 |
| 6,695,336 | B1 * | 2/2004 | Grabenstetter | B60P 3/1033 | 280/414.2 |
| 7,004,495 | B2 * | 2/2006 | Thurm | B60P 3/07 | 108/167 |
| 7,258,362 | B2 * | 8/2007 | Thurm | B60P 3/07 | 280/491.1 |
| 2012/0091688 | A1 * | 4/2012 | Fink | B60P 3/1033 | 280/414.1 |
| 2019/0308706 | A1 * | 10/2019 | Divry | B63C 13/00 | |

* cited by examiner

HITCHING DEVICE

FIELD OF THE INVENTION

The present invention relates in particular to the safe transport of boats on solid surfaces.

A preferred application is in the boat building industry and more particularly in light water crafts both for tourism and professionals.

TECHNOLOGICAL BACKGROUND

In the latter field, many passenger boats that can be positioned on a trailer in order to be towed by a conventional land vehicle are known.

Thus, the trailer includes a hitching device to connect the trailer to the towing vehicle. These trailers are cumbersome, particularly because they are longer than the length of the boat they carry.

This applies both to an amphibious vehicle capable of moving both in a liquid medium (mainly water) and on solid surfaces. Conventionally, the hitching device is attached to one end of the amphibious vehicle.

One of the major drawbacks of such a system is the large size of the hitching device when navigating the boat in the liquid environment. It is also provided that such a device may be stored vertically on the boat. In this case the hitching device acts as a mast and stability problems may arise.

Thus, it is desirable to find a solution that limits the drawbacks described.

The present invention makes it possible to solve all or at least some of the drawbacks of the current techniques.

SUMMARY OF THE INVENTION

One aspect of the invention more particularly relates to a boat comprising a hull capable of being towed on a solid surface and comprising a hitching device comprising a straight drawbar and a hitching mechanism. The hitching device is movable in translation along a translation axis parallel to a longitudinal axis of the hull between a stowed position and a deployed position in which the hitching device extends further out of the hull than when in the stowed position. Advantageously said boat has a hitching device which is movable in translation along an axis parallel to a longitudinal axis of the hull between a stowed position in which the hitching device is more retracted into the hull at a deployed position in which the hitching device is further out of the hull than when in the stowed position.

This advantageous characteristic makes it possible for the boat to comprise a hitching device that perfectly ensures a safe land transportation of the boat and the drawbacks and relative size of which are limited.

BRIEF DESCRIPTION OF THE FIGURES

Other characteristics, aims and advantages of the present invention will appear upon reading the following detailed description and referring to the appended drawings given as non-limiting examples and wherein.

DETAILED DESCRIPTION

Figure 1:
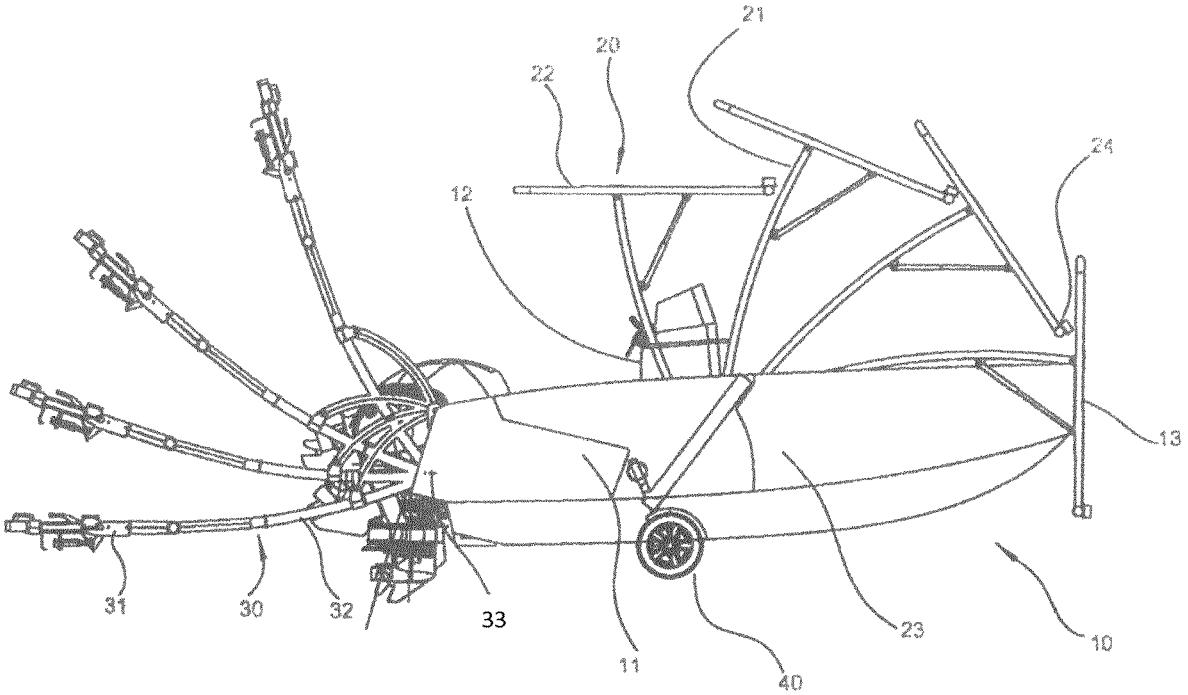
FIG. 1 shows a side view of an amphibious vehicle with an underrun protection device and an unclaimed hitching device.

Prior to going into details relating to the preferred embodiments of the invention while referring more particularly to the drawings, other optional characteristics of the invention which may be implemented in any combination or alternately, are mentioned hereafter:

- the boat comprises a hull that is suitable for being towed on a solid surface, said boat has an underrun protection device so configured as to be movable between a first position in which the device is in an underrun protection function and a second position in which the device is not in an underrun protection function.
- the hull comprises an axis of rotation parallel to the width axis of said hull and in which the axis of rotation is so configured as to enable the underrun protection device to move from the first position to the second position and vice versa.
- the underrun protection device consists of at least one arm and at least one structure.
- which the arm comprises a first end so configured as to be connected to the axis of rotation, and a second end so configured as to be connected to the structure.
- a rigid hitching device having a non-zero dimension in a direction transverse to the hull.
- the underrun protection in the second position has at least one secondary function taken from the following functions: sun shade, cane holder, water-sport rope attachment, winch, signalling.
- the hitching device is movable in rotation along an axis of rotation parallel to the width axis of the hull, between a hitching position and a raised position.
- the hitching device is movable in translation along an axis parallel to a longitudinal axis of the hull.
- the hitching device includes a sheath so configured as to enable the hitching device to move in the hull.
- a manoeuvring assistance system so configured as to assist the boat motions on the solid surface.
- the manoeuvring assistance system includes at least one roller and a radio frequency transmitter/receiver so configured as to remotely control the at least one roller.
- in the first position, the underrun protection device is facing the side walls of the hull and in the second position the underrun protection device is facing the hull deck.
- the boat has at least one wheel and preferably two wheels.
- the hull includes a sheath so configured as to enable the hitching device to move inside said hull when being stowed.
- the sheath includes a hatch making it possible to seal the sheath when the hitching device is stowed.
- the hitching device includes a system for locking the deployed position.

the hitching device includes a translation locking system.

the hitching device locking system comprises an angular motion of said hitching device about its translation axis so configured that said hitching device is movable between an active position in which the translation displacement of the hitching device is allowed to an inactive position in which the translation displacement of the hitching device is prevented.

the hitching device locking system is so configured as to lock the translation of the hitching device into a first angular position of the hitching device along the translation axis and to allow the translation of the hitching device into a second angular position different from the first angular position of the hitching device along the translation axis. The angular shift between the first angular position and the second angular position is between 90° and 270° and preferably 180°.

wherein a guide rail having substantially a U-shape is attached to the straight drawbar by its base, said guide rail is so configured as to cooperate with a stop and preferably a pin is integral with the sheath.

the guide rail is attached to the straight drawbar relative to a hitching face of the hitching mechanism.

an underrun protection device is so configured as to be movable between a first position in which the device is in underrun protection function and a second position in which the device is not in underrun protection function.

the first position of the underrun protection device is so configured as to be below the second position.

the boat includes at least one wheel so configured as to enable said boat to move on a solid surface and wherein the first position of the underrun protection device is so configured as to be above at least a portion of the wheel.

the underrun protection device comprises at least one arm and at least one structure, said structure comprises signal lights for maritime navigation and for land travel.

In order to have a good understanding of the invention that will be described, the following terms will have the following meanings:

Longitudinal axis of the boat means the axis extending between the bow and the stern of the boat Transverse axis of the boat means the axis perpendicular to the longitudinal axis and in a plane corresponding to the trim of the boat, generally predominantly horizontal.

The present invention relates to a boat 10 the hull 11 of which carries in particular an underrun protection device 20 and/or a hitching device 30.

Advantageously, the hull 11 includes side walls so configured as to be in contact with water, and a deck so configured as to accommodate not only the boat users, but also all the elements of the boat.

Advantageously, if the hull 11 includes a hitching device 30 or means for attaching a hitching system 30 at its bow 13 or stern 14, then it also includes at least one wheel 40. In this embodiment, the boat 10 is therefore an amphibious vehicle capable of moving both in a liquid medium such as water and on a solid surface.

According to the invention, when the boat 10 moves on a solid surface (either through its at least one wheel 40 or when positioned on a trailer) it is important to have an underrun protection device 20.

According to the invention, when the boat 10 moves on a solid surface (either by means of its at least one wheel 40, or when positioned on a trailer) it is useful to have a hitching device 30, especially when the latter is not present on the trailer.

The Hitching Device 30

The hitching device 30 is so designed as to be able to tow the boat when moving on a solid surface and for launching the boat/taking the boat out of water. Said hitching device 30 comprises a hitching mechanism 31 making it possible to connect same to the vehicle and a hitching structure 32.

Preferably, the hitching mechanism 31 comprises a gripping face comprising a handle, and an attaching face comprising a cavity, with the gripping and attaching faces being advantageously opposite one another The hitching device 30 is preferably located at the stern 14 of the hull 11.

The hitching device 30 is movable in translation inside the hull 11 along an axis parallel to the longitudinal axis of the hull. The translation axis of the hitching device 30 can coincide with the longitudinal axis of the hull.

Thus, the hitching device 30 is movable between a deployed position and a stowed position in which the bar is more retracted into the hull than when in the deployed position.

This mobility is made possible by a sheath 34 provided in the hull. Stops, not visible in the figures, limit the movement of the hitching structure 32 relative to the sheath 34. It is also possible to provide a length of the hitching structure 32 allowing the positioning of one or more end stop(s) towards the deployed position and/or towards the stowed part, for example in series, in order to increase safety when towing the boat 10. A waterproof hatch 35 makes it possible, when the hitching device 30 is stowed into the hull 11, to prevent water from entering said hull 11 at a mouth of the sheath. The hatch 35 seals off the sheath inlet 34. Thus, when closing the hatch 35, the sheath is hermetically sealed. The trapdoor then opens to allow the deployment of the hitching device 30.

This embodiment has many advantages. By integrating the device inside the hull 11, the centre of gravity of the boat 10 is lowered, thus providing it with greater stability. In addition, the hitching device 30 can add a weight to the bow 13 of the boat 10. This can facilitate the squat of the boat 10 at low speed and thus reduce fuel consumption. Finally, since there is no axis of rotation 33 transverse to the axis of translation, the safety of the boat 10 during towing is further increased by reducing the weak points of the hitching device 30.

Advantageously, the hitching device 30 includes a system for locking the deployed position. Preferably, the hitching device 30 is movable in an angular motion between an inactive position, in which the translation of the hitching device is locked, and an active position in which the translation of the hitching device 30 is allowed. Advantageously, the angular motion is between 90° and 270° and preferably 180°.

During the angular motion, a stop on one of the hitching device 30 and/or the sheath 34 interacts with a groove on the other one of the hitching device 30 and/or the sheath 34 to lock the translation of the hitching device 30. These elements are not visible in the figures. Of course, the number of pins/grooves may vary to reinforce the locking.

Preferably, a pin is present on the straight drawbar 39 and a groove extends in the longitudinal direction of the sheath 34. A second groove is positioned radially in the sheath 34. Thus, when the pin engages in this second groove, its movement in the first groove is no longer possible. As a result, the translation of the pin into the first groove is no longer possible and therefore the translation of the hitching device 30 is locked.

Advantageously, the hitching device 30 can include a guide rail 38. The guide rail 38 then substantially has a U shape. Preferably, the guide rail 38 is attached to the straight drawbar by its base plate. Said guide rail 38 is so configured as to cooperate with a stop (not shown in the figures) integral with the sheath 34. Preferably, the stop has the shape of a pin. Thus, when the hitching device 30 is in the stowed position, cooperation between the pin attached in the sheath 34 and the guide rail 38 ensures that the hitching device 30 is correctly positioned, but also limits any rotation inside the sheath 34. As a result, there is no risk of movement of the hitching device 30 when the boat is navigating.

Preferably the guide rail 38 is attached on the straight drawbar 39 relative to the attaching face of the hitching mechanism 31. Thus, the guide rail 38 never interferes with the correct gripping of the hitching mechanism 31. Additionally, in this embodiment a U-shaped rail can be added in the sheath 34. This U-shaped rail cooperates with the handle of the hitching mechanism 31. Thus, this reinforces the holding of the hitching device 30 in the sheath 34. In an alternative embodiment, there is no guide rail on the straight drawbar, but only in the sheath 34.

Of course, alternative systems for locking the hitching device 30 in the deployed position at the angular displacement of the hitching device are possible.

For example, retractable pins may be positioned in the straight drawbar on the portion of the straight drawbar which remains in the sheath when the hitching device 30 is deployed, and cooperate with the sheath 34. In this embodiment, a control device enables to retract the pins and thus enables the hitching device 30 to be stowed into the sheath 34.

In an alternative embodiment, the hitching device 30 can be rotated along an axis of rotation 33 parallel to the width dimension of the hull 11. It can thus be switched from a towing position to a raised position.

This can be substantially at 90° relative to the hitching position. The hitching device may be framed by the two ranges and/or include two spaced longitudinal members so as to form a motion space around the engine. The hook can be attached to a transverse part of the hitching device 30. The device may be made up of two independent and tilting parts, at least one of which includes the hitching hook. In one embodiment of the invention, the hitching device 30 includes a hook for attaching a water-ski rope, but also an electric winch, providing assistance when launching the amphibious vehicle/taking same out of water.

In the hitching position, said hitching device 30 is in the extension of the bow 13/stern 14 axis of the hull 11. In this position, it makes it possible for the boat 10 to be towed by another vehicle.

In the raised position, the hitching device 30 is held along an axis parallel to the first axis.

The hitching structure may include one or more bar(s). The bars can advantageously be telescopic. The desired length can thus be quickly and easily adjusted either for towing the boat 11 or for avoiding raising the centre of gravity of the boat 11 when navigating on water. This improves, in particular, the stability of the boat 11. In addition, the hitching device 30 may include a sliding chainplate (visible in FIGS. 1 and 2) in order to assist the rotation of said hitching device 30, which further improves the safety of said boat.

The Underrun Protection System 20

The underrun protection device 20 is carried by the hull 11 of the boat 10 of the present invention.

Preferably, the underrun protection device 20 consists of at least one arm 21 and at least one structure and preferably two arms 21 and one structure 22. Finally, the underrun protection device 20 is so configured as to be able to switch from a first position to a second position and vice versa.

The Arm 21

Advantageously, the arm 21 has two ends. One end of the arm is connected to the axis of rotation 23 and the other end is connected to the structure 22. In an alternative embodiment of the invention, the arm 21 and the structure 22 are formed as a monolithic part. The arm 21 can be made of different materials. In the preferred embodiment of the invention, the arm 21 is made with a tube, especially in stainless steel. This preferred embodiment provides good resistance to stress, while limiting the mass of the underrun protection device. In the first position of the underrun protection device, said arm 21 is oriented in a predominantly horizontal direction. In the second position of the underrun protection device, the arm 21 is oriented in a predominantly vertical direction (see FIG. 1). The arm 21 can be straight. It can also have a curved shape as shown in FIG. 1. The shape of the arm 21 described is not restrictive, and other shapes are of course possible.

Advantageously the lower end of the arm 21 is connected to the hull 11 at a steering console 12 of the boat 10. A steering console 12 is defined as the part of the boat 10 used to control, in particular, the direction and speed of the boat 10. Preferably, the length of the arm 21 is longer than the length separating the axis of rotation 23 and the bow 13 and/or the stern 14 of the hull 11 of the boat 10. This advantageous configuration enables the arm 21 to reach one end of the hull 11 and the structure 22 to protrude from the hull (FIG. 1 for example) when positioning the underrun protection device 20 in its first position. In an alternative embodiment, the arm 21 is telescopic. Thus, it can quickly be adjusted to the desired length of the first and/or second positions.

In one embodiment of the invention, the arm may carry, on its longitudinal dimension, signal elements 25 in particular for maritime navigation and in particular navigation lights (port, starboard and anchoring).

The Structure 22

The structure 22 is advantageously made of stainless steel tubes. Of course, other materials can be used and this embodiment is not restrictive. Advantageously, the structure 22 includes a length dimension and a width dimension. Advantageously, the length dimension of the structure 22 is the dimension parallel to the longitudinal axis of the boat 11. The width dimension of the structure 22 is parallel to the width dimension of the boat 11.

Preferably, the structure 22 is so configured as to carry at least one support 24. The support can bear the registration plate 26 (for land vehicles) and/or the signal elements 25. In another embodiment of the invention, the registration plate and/or signal elements 25 are carried directly by the structure 22. The signal elements 25 can be signal elements 25 for travelling on solid surfaces (dipped-beam headlamp, backup light, brake light, etc.), but also navigation light signal elements (port side, starboard, anchoring). Unique signal elements can be used for both land and sea travel. For example, maritime navigation lights may be positioned on one side of the signal element, whereas land signal lights may be carried by the upper face of the signal element.

In the preferred embodiment of the invention, the structure 22 is a frame the length dimension of which is greater than or equal to the width dimension. In a non-preferred embodiment, the width of the frame may be greater than its length. Preferably, the width dimension is greater than or equal to the width of the boat 10. In an alternative embodiment, the width dimension is smaller than or equal to the trim width of the boat 10.

Advantageously, the frame can accommodate a canvas inside it which makes it possible to have a sunshade or cover effect when the boat is sailing at sea. As the canvas is removable, it can be removed when travelling on a solid surface.

In the embodiment where the width of the frame is smaller than or equal to the width of the boat 10, the connection between the structure 22 and the arm 21 is provided on a longitudinal portion of the frame (FIG. 1 for example).

Figure 2:
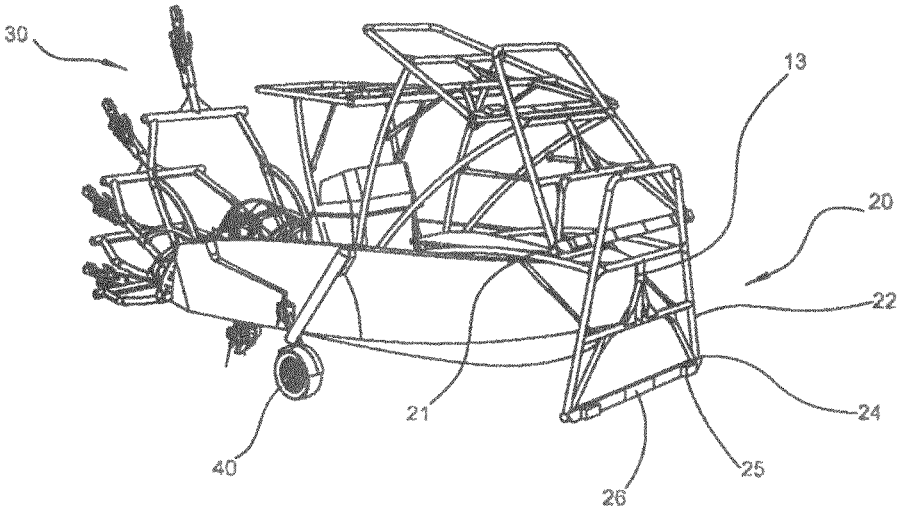
FIG. 2 shows a three-quarter view of the embodiment of FIG. 1.

For all the embodiments of the structure 22, the connection can be made inside the frame, thanks in particular to an additional connection element. The additional connection element can be, for example, a bar or a crossbar. Advantageously the presence of at least one crossbar reinforces the rigidity of the frame. Thus, to stabilize the frame, an additional support element can be positioned. In the embodiment of FIGS. 1 and 2, this complementary element is a piston positioned so as to balance the frame and preferably form a triangle with the arm 21 and the structure 22.

In one embodiment of the invention, the connection between the structure 22 and the arm 21 enables the structure 22 to pivot around the connection. Thus, for example, the inclination of the structure 22 relative to the horizontal can be variable.

The structure can also, in an alternative embodiment, have the shape of an arch. In this embodiment not shown in the figures, the length dimension of the structure 22 is smaller than the width dimension of said structure. The arch can be curved and/or straight.

Advantageously, the structure 22 has a predominant position perpendicular to the support on the arm 21. Thus, when the underrun protection device 20 is in its first position, the structure 22 has a predominantly vertical orientation. Conversely, when the underrun protection device 20 is in its second position, the structure 22 has a predominantly horizontal orientation.

The structure 22 can include at least one of the following additional elements: a canvas, a cane holder, a hook, a winch. These elements are not exhaustive, and other elements may be included and/or added on the structure. These additional elements enable the structure 22 to have various second functions, especially when the underrun protection device is in its second position. The hook, for example, can be used to attach a rope to practice water sports such as water skiing or wakeboarding.

An electrical connection and wiring are advantageously present in and/or on the structure 22 and the arm 21. This electrical connection is of course waterproof and makes it possible to connect the signal elements 25 to the console 12 and/or the towing vehicle when travelling on a solid surface. Thus, this solution offers the advantage of limiting the problems of immersion of electrical connections. In addition, the vehicle/boat connection can be made on a portion closer to the vehicle in order to ensure that it is not submerged when the boat 10 is launched and taken out of the water.

Axis of Rotation 23, Function and Use of the Underrun Protection Device

One of the primary functions of the underrun protection system 20 is to prevent pedestrians and/or two-wheelers from being caught under the wheels 40 of the boat 10 and/or the trailer in the event of an accident. Advantageously, the underrun protection device also includes at least one secondary function.

The various functions of the underrun protection device 20 enable it to adapt to the travelling of the boat 10 both on a solid surface and on water. This adaptability according to the travelling environment is provided by the ability for the underrun protection device 20 to move from a first position to a second position. Preferably, the first position is below the second position.

The transition from the first position to the second position is advantageously done by a rotational movement. In order to achieve this rotational movement, the hull 11 includes an axis of rotation 23.

Figure 3:
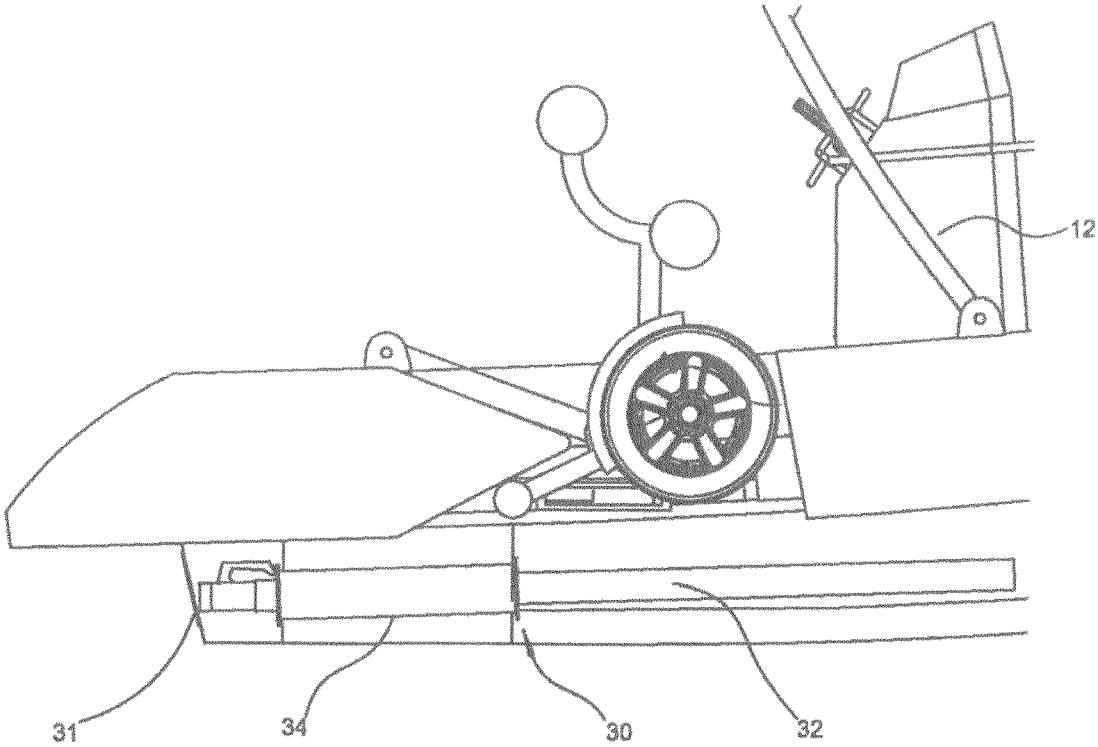
FIG. 3 is a lateral view of an amphibious vehicle in the maritime navigation position with a hitching device movable in translation in the hull.
Figure 4:
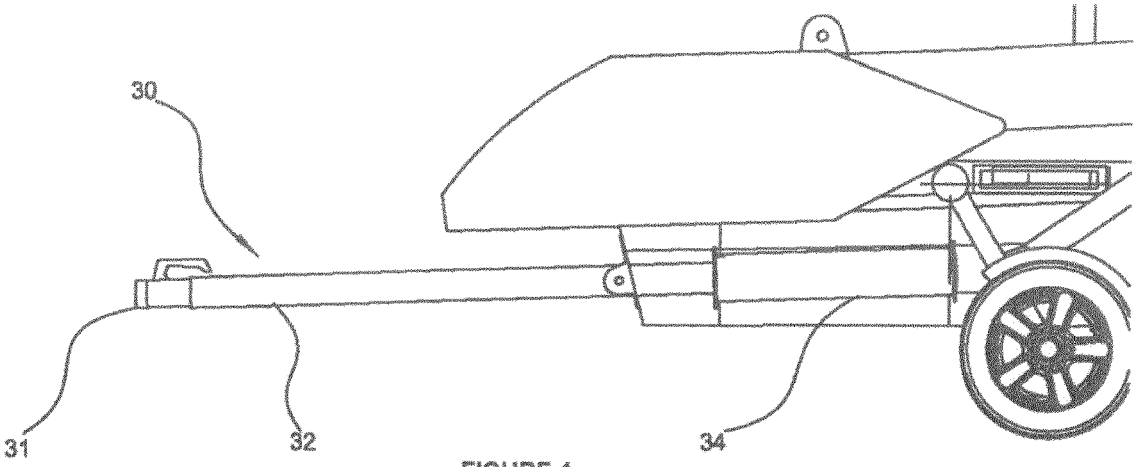
FIG. 4 is a lateral view of an amphibious vehicle in the land travel position with a hitching device movable in translation in the hull.
Figure 5:
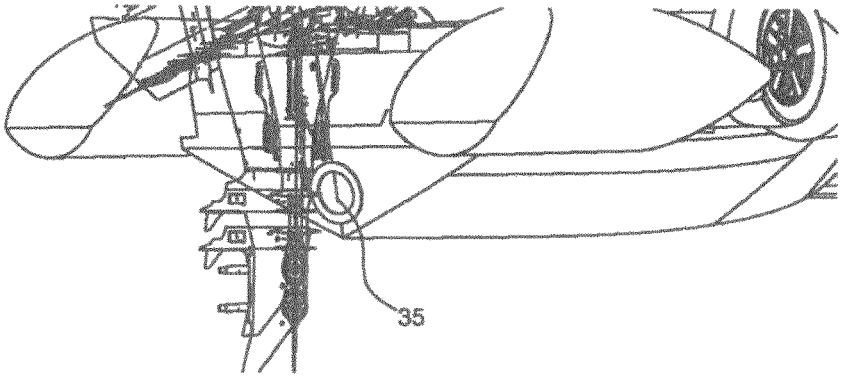
FIG. 5 is a rear view showing a closed watertight hatch.
Figure 6:
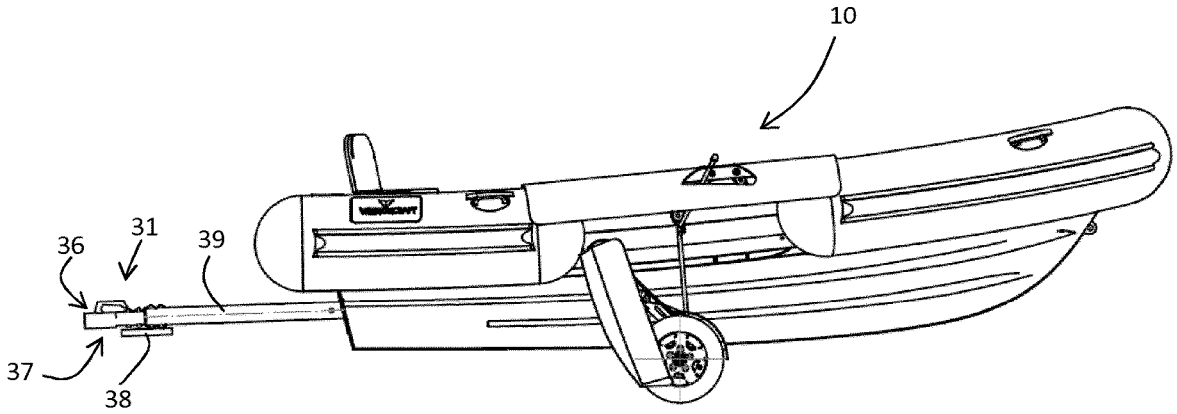
FIG. 6 shows a boat with the hitching device in the deployed and locked position
Figure 7:
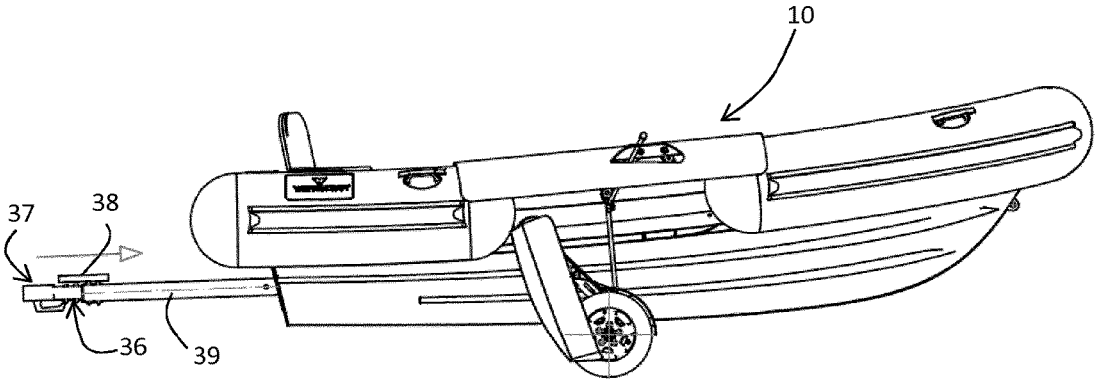
FIG. 7 shows the hitching device in the deployed and unlocked position
Figure 8:
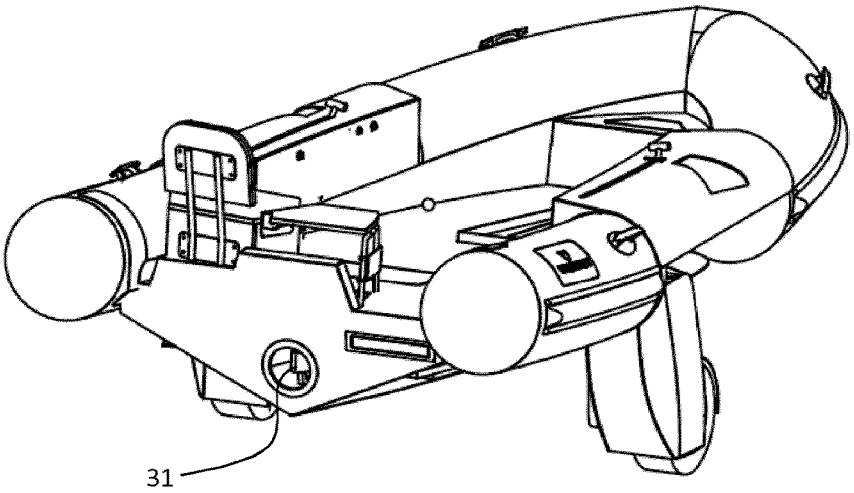
FIG. 8 shows a three-quarter rear view with the hitching device stowed.

Advantageously, the axis of rotation 23 is parallel to the transverse axis of the boat 10. Preferably, the rotation axis 23 is a geometric axis. This means that there is not necessarily a physical axis crossing the width of the boat 10. In this embodiment, rotating fasteners may be present on the hull 11 and on the axis of rotation 23, for example. In another embodiment, the rotating fasteners are carried by the console 12 (see FIG. 3 for example). The rotation of the underrun protection device 20 aims at moving the underrun protection device 20 from a first position to a second position. Advantageously, the first position of the underrun protection device 20 corresponds to at least one first function, and the second position of the underrun protection device 20 corresponds to at least one second function.

The first function preferably corresponds to the underrun protection device beam function. In this position, the structure 22 has at least one portion located at the hubs of the trailer wheels and/or of the wheel 40. The aim is to reduce the distance between the ground and the hull 11 in order to prevent a pedestrian and/or two-wheeled vehicle from being caught under the wheels of the trailer and/or the wheel 40. Thus, in the first position, the structure 22 must have at least one portion at a distance ranging from 40 to 55 centimetres (cm) from the ground and of preferably 50 cm from the ground. This preferred position more particularly makes it possible to have an intermediate element between the ground and the hull 11 which prevents a pedestrian and/or a two-wheeled vehicle from being caught under the wheels of the trailer and/or the wheel 40 by lowering the guard.

The second function of the underrun protection device 20 is preferably a cover or sun shade function. As a matter of fact, in the second position of the underrun protection device 20, the structure 22 has a predominant horizontal position. Thus, thanks to a canvas filling the frame of the structure (preferential embodiment of the invention), the latter can create a cover.

Thanks to this embodiment of the invention, i.e. a boat 10 with an integrated underrun protection device 20, said boat 10 guarantees a safe movement on a solid surface for the people around it while limiting the drawbacks of the presence of an underrun protection device 20. Reusing this underrun protection device 20 saves weight, space and increases the overall safety of the boat.

Manoeuvring Assistance System

Finally, in one embodiment where the boat 10 has at least one wheel 40 and is thus considered as an amphibious vehicle, a watertight manoeuvring assistance system is present on the at least one wheel 40. Such manoeuvring assistance system includes at least one roller and one radio wave transmitter/receiver. Advantageously, the radio wave transmitter/receiver makes it possible to control the at least one roller specifically by means of a remote control. Other control means are of course possible.

The advantage of the manoeuvring assistance system is that it gives a user a better control on the launching and the lifting of the boat 10 out of the water. Having a better control on these manoeuvres increases the safety of the boat.

The invention is not limited to the embodiments described above but applies to all the embodiments complying with the spirit thereof. Thus, all the elements put in the singular also include their achievements with a plurality of elements and are not restrictive of the presence of a single element. Similarly, all the embodiments described are not mutually exclusive. Finally, it should be understood that the term boat 10 throughout the description includes both boats 10 capable of moving only in a liquid environment and amphibious vehicles capable of moving in different environments, including an aquatic environment.

REFERENCES

10. Ship
11. Hull
12. Steering console
13. Bow
14. Stern
20. Underrun protection device
21. Arm
22. Structure
23. Axis of rotation
24. Support
25. Signal elements
26. Registration plate
30. Hitching device
31. Hitching mechanism
32. Hitching structure
33. Axis of rotation
34. Sheath
35. Access hatch
36. Gripping face
37. Hitching face
38. Guide rail
39. Straight drawbar
40. Wheel

The invention claimed is:

1. A boat comprising a hull that is suitable for being towed on a solid surface and comprises a hitching device comprising a straight drawbar and a hitching mechanism, wherein the hitching device is movable in translation along a translation axis parallel to a longitudinal axis of the hull between a stowed position and a deployed position in which the hitching device extends further out of the hull than when in the stowed position, wherein the hull comprises a sheath so configured as to allow the translation of the hitching device into said hull during the stowing thereof; and wherein the sheath includes a hatch for sealing said sheath in the stowed position of the hitching device.

2. A boat according to claim 1, wherein the hitching device includes a translation locking system.

3. A boat according to claim 2, wherein the hitching device locking system is so configured as to lock the translation of the hitching device in a first angular position of the hitching device along the translation axis and to allow the translation of the hitching device in a second angular position different from the first angular position of the hitching device along the translation axis.

4. A boat according to claim 3, wherein the angular shift of the first angular position and the second angular position is between 90° and 270°.

5. A boat according to claim 1, wherein a guide rail having substantially a U shape is attached on the straight drawbar by its base, with said guide rail being so configured as to cooperate with a stop integral with the sheath.

6. A boat according to claim 5, wherein the guide rail is attached on the straight drawbar facing a hitching face of the hitching mechanism.

7. A boat according to claim 1 comprising an underrun protection device so configured as to be movable between a first position in which the device is in an underrun protection function and a second position in which the device is not in an underrun protection function.

8. A boat according to claim 7, wherein the first position of the underrun protection device is so configured as to be below the second position.

9. A boat according to claim 7, comprising at least one wheel so configured as to allow said boat to be moved on a solid surface and wherein the first position of the underrun protection device is so configured as to be above at least a portion of the wheel.

10. A boat according to claim 7, wherein the underrun protection device comprises at least one arm and at least one structure, said structure comprises signal lights for maritime navigation and for land travel.

11. A boat comprising a hull that is suitable for being towed on a solid surface and comprises a hitching device comprising a straight drawbar and a hitching mechanism, wherein the hitching device is movable in translation along a translation axis parallel to a longitudinal axis of the hull between a stowed position and a deployed position in which the hitching device extends further out of the hull than when in the stowed position, wherein the hitching device includes a translation locking system, wherein the hitching device locking system is so configured as to lock the translation of the hitching device in a first angular position of the hitching device along the translation axis and to allow the translation of the hitching device in a second angular position different from the first angular position of the hitching device along the translation axis, and wherein the angular shift of the first angular position and the second angular position is 180°.

12. The boat according to claim 11, wherein the angular shift of the first angular position and the second angular position is between 90° and 270°.

13. The boat according to claim 11, wherein a guide rail having substantially a U shape is attached on the straight drawbar by its base, with said guide rail being so configured as to cooperate with a stop integral with the sheath.

14. The boat according to claim 13, wherein the guide rail is attached on the straight drawbar facing a hitching face of the hitching mechanism.

15. The boat according to claim 11 further comprising an underrun protection device so configured as to be movable between a first position in which the device is in an underrun protection function and a second position in which the device is not in an underrun protection function.

16. The boat according to claim 15, wherein the first position of the underrun protection device is so configured as to be below the second position.

17. The boat according to claim 15, comprising at least one wheel so configured as to allow said boat to be moved on a solid surface and wherein the first position of the underrun protection device is so configured as to be above at least a portion of the wheel.

18. The boat according to claim 15, wherein the underrun protection device comprises at least one arm and at least one structure, said structure comprises signal lights for maritime navigation and for land travel.

* * * * *